US007882609B2

(12) United States Patent
Hsu et al.

(10) Patent No.: US 7,882,609 B2
(45) Date of Patent: Feb. 8, 2011

(54) KEY, X-STRUCTURE AND MANUFACTURING METHOD THEREOF

(75) Inventors: Chien-Shih Hsu, Taipei (TW); Pin-Chien Liao, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 1218 days.

(21) Appl. No.: 11/501,354

(22) Filed: Aug. 9, 2006

(65) Prior Publication Data

US 2007/0033792 A1 Feb. 15, 2007

(30) Foreign Application Priority Data

Aug. 10, 2005 (TW) ..... 94127089 A

(51) Int. Cl.
*B23P 11/00* (2006.01)
*H01H 13/70* (2006.01)

(52) U.S. Cl. ..... 29/436; 200/344

(58) Field of Classification Search ..... 29/428, 29/436, 438, 446, 449, 448, 450, 459; 200/344, 200/5 A, 512, 517, 345
See application file for complete search history.

(56) References Cited

U.S. PATENT DOCUMENTS 6,444,933 B1 * 9/2002 Chun ..... 200/344

* cited by examiner

*Primary Examiner*—John C Hong

(57) ABSTRACT

A X-structure of a key and a manufacturing method thereof are disclosed. The X-structure comprises a first frame and a second frame. The first frame comprises a bar. The first frame is connected and pivoted to the second frame via a fold located on the bar. The key comprises a keycap, a base and the X-structure installed between the keycap and the base. The manufacturing method of the X-structure comprises: providing the X-structure and pressing the bar to generate a fold until the first engaging portions are connected and pivoted to the second engaging portions.

9 Claims, 9 Drawing Sheets

KEY, X-STRUCTURE AND MANUFACTURING METHOD THEREOF

BACKGROUND OF THE INVENTION

1. Field of the Invention

The invention relates to an X-structure of a key and a manufacturing method thereof.

2. Description of the Related Art

Referring to FIG. 1, a conventional X-structure 20 of a key comprises two frames 21 and 22. The frames 21 and 22 respectively comprise a first engaging portion 211 and a second engaging portion 221 pivoted to the first engaging portion 211 allowing the frames 21 and 22 to rotate. A conventional X-structure 20 manufacturing process first forms X-structure 20 of frames 21 and 22 by plastic injection molding. The frames 21 and 22 are then assembled via manually assembeled. Manufacture of keyboards is labor intensive, as each keyboard comprises a hundred or more X-structures 20. Thus, manufacturing costs for keyboards utilizing a conventional X-structure 20 are high and yield is low.

BRIEF SUMMARY OF INVENTION

The invention provides a key comprising a keycap, a base, a first frame and a second frame. The first frame comprises a first end, a second end, a first engaging portion and a bar. The first end supports the keycap and the second end is connected to the base. The second frame comprises a third end, a fourth end, a second engaging portion. The first engaging portion is connected and pivoted to the second engaging portion via a fold located on the bar. The first end and the third end support the keycap. The second end and the fourth end are connected to the base.

The invention provides an X-structure comprising a first frame and a second frame. The first frame comprises a first engaging portion and a bar. The second frame comprises a second engaging portion. The first engaging portion is connected and pivoted to the second engaging portion via a fold located on the bar.

Methods for manufacturing an X-structure are provided. In an exemplary embodiment of a method for manufacturing an X-structure, an X-structure comprises a first frame and a second frame, wherein the first frame comprises a pair of first engaging portions and a bar connecting to the first engaging portions. The second frame comprises a pair of second engaging portions, and presses the bar to generate a fold until the first engaging portions are connected and pivoted to the second engaging portions.

In another embodiment of a method for manufacturing an X-structure, the X-structure comprises a first frame, a second frame, and a connecting element connecting to the first frame and the second frame. The first frame comprises a pair of first engaging portions and a bar. The second frame comprises a pair of second engaging portions. Manufacturing steps comprise: pressing the connecting element along a first direction to generate a fold causing the first frame approach the second frame until the first engaging portions and the second engaging portions are arranged in a straight line; pressing the connecting element and the bar along a second direction to generate a fold until the first engaging portions are connected and pivoted to the second engaging portions, and separating the first frame and the second frame from the connecting element.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
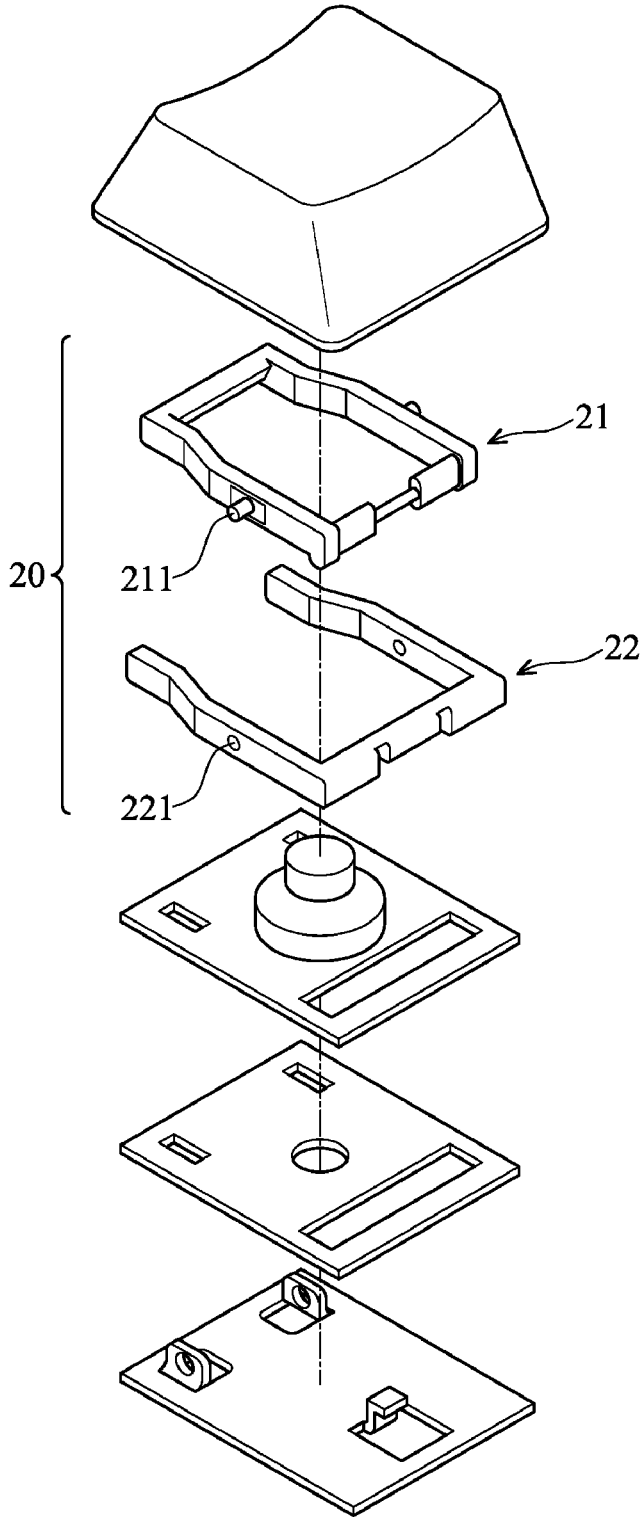
FIG. 1 ( PRIOR ART )
FIG. 1 is an exploded view showing a conventional X-structure.
Figure 2A:
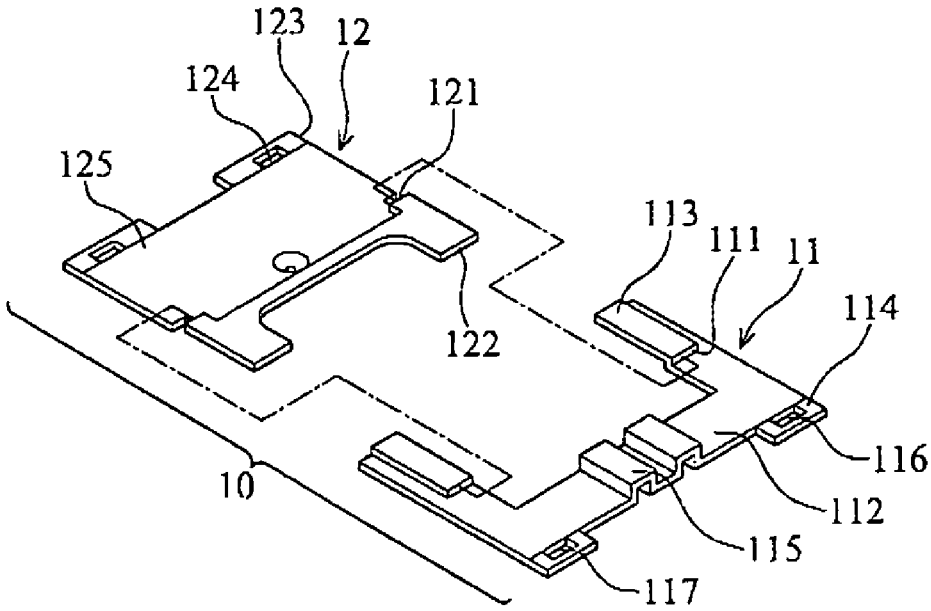
FIG. 2A is an exploded view showing an X-structure of the invention.
Figure 2B:
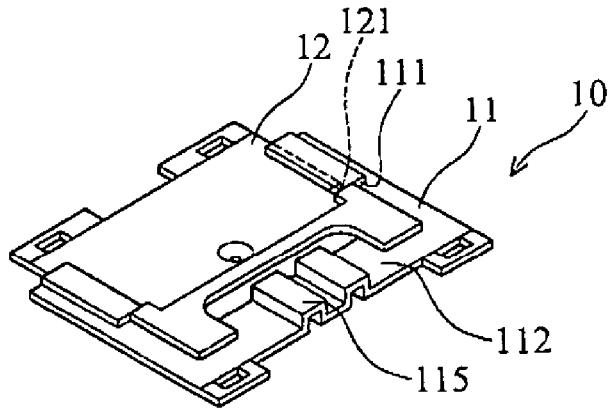
FIG. 2B is a schematic view of an X-structure of the invention.

Referring to FIGS. 2A and 2B, an X-structure 10 of a key comprises a first frame 11 and a second frame 12. The first frame 11 comprises a pair of first engaging portions 111 and a bar 112. The second frame 12 comprises a pair of second engaging portions 121. The first engaging portions 111 are connected and pivoted to the second engaging portions 121 via a fold 115 located on the bar 112. Note that the first frame 11 and the second frame 12 comprise metal.

Figure 3A:
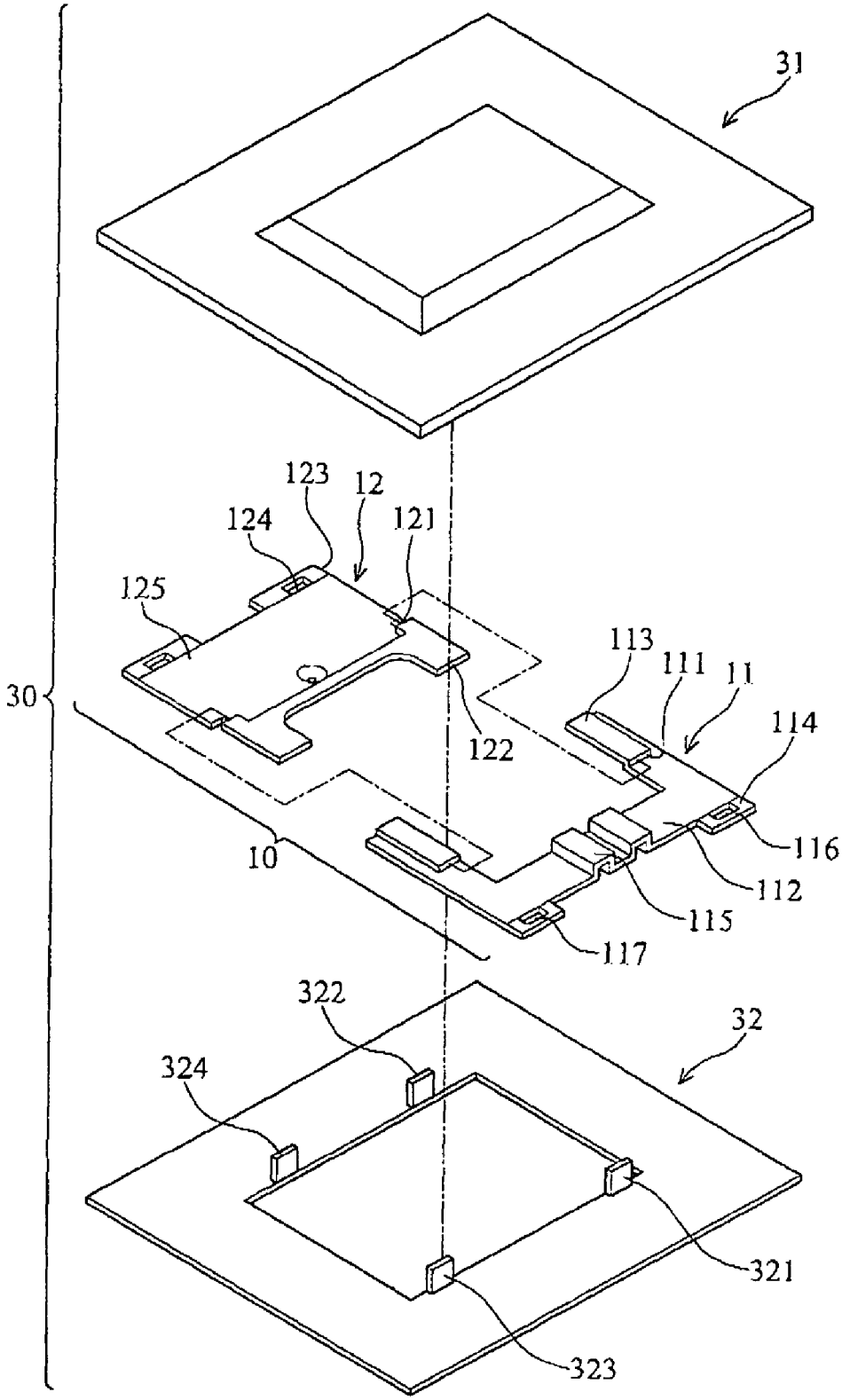
FIG. 3A is an exploded view showing a key of the invention.
Figure 3B:
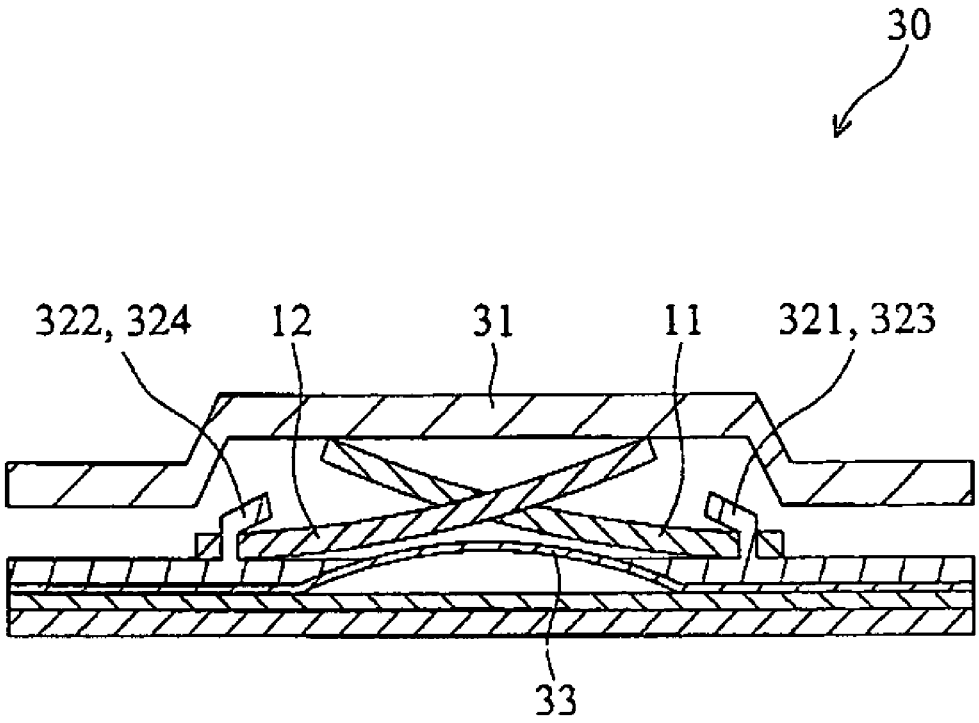
FIG. 3B is a schematic view of a key of the invention.

Referring to FIGS. 3A and 3B, the key 30 comprises a keycap 31, a base 32 and the X-structure 10 (the X-structure 10 comprises a first frame 11 and a second frame 12). The base 32 comprises two first connectors 321 and 323 and two second connectors 322 and 324. The first frame 11 further comprises a first end 113 and a second end 114. The second frame 12 further comprises a third end 122 and a fourth end 123. The first engaging portions 111 are connected and pivoted to the second engaging portions 121 via a fold 115 located on the bar 112. The first end 113 and the third end 122 support the keycap 31. In this embodiment, the second end 114 and the fourth end 123 comprise holes 116, 117, 124, and 125. The first connectors 321 and 323 and the second connectors 322 and 324 are protrusions accommodated by holes 116, 117, 124, and 125 for assembling the X-structure 10 and the base 32. The key 30 further comprises an elastic element 33 between the keycap 31 and the base 32. Thus, after pressing the keycap 31, the keycap 31 can automatically rebound. Note that the elastic element 33 comprises metal. The protrusions 321 to 324 protrude from the base 32, thus, the X-structure 10 is connected to the base 32 by inserting the protrusions 321 to 324 into the holes 116, 117, 124 and 125, and bending the protrusions 321 to 324 to fix the X-structure 10 to the base 32.

Figure 4:
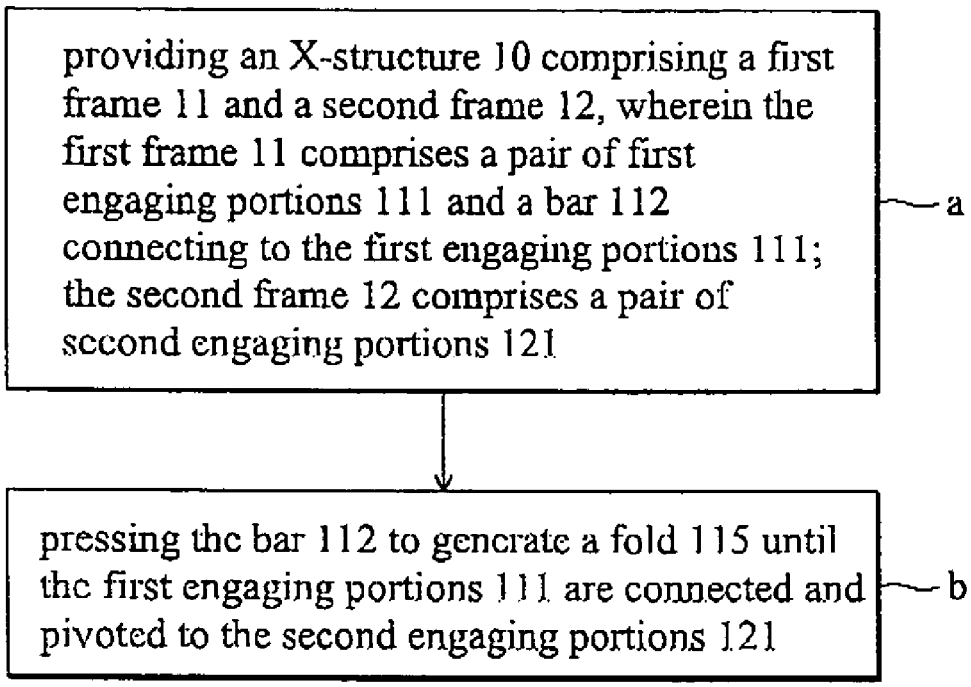
FIG. 4 shows a flow chart of an embodiment of an X-structure of the invention.
Figure 5A:
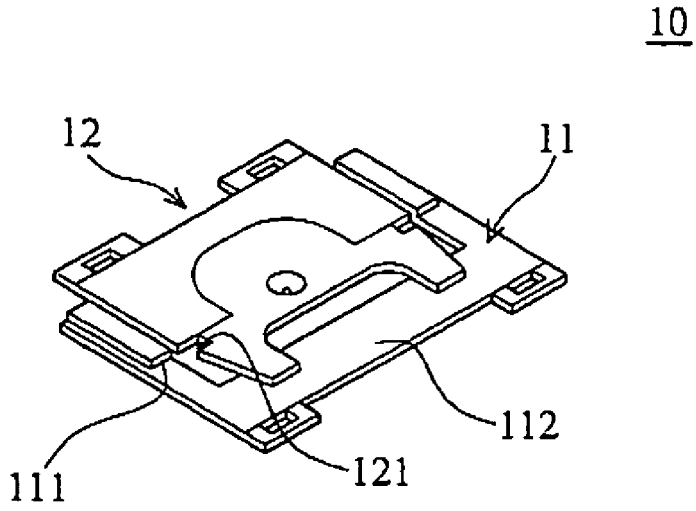
FIGS. 5A-5B are schematic views showing the assembly of an embodiment of an X-structure of the invention
Figure 5B:
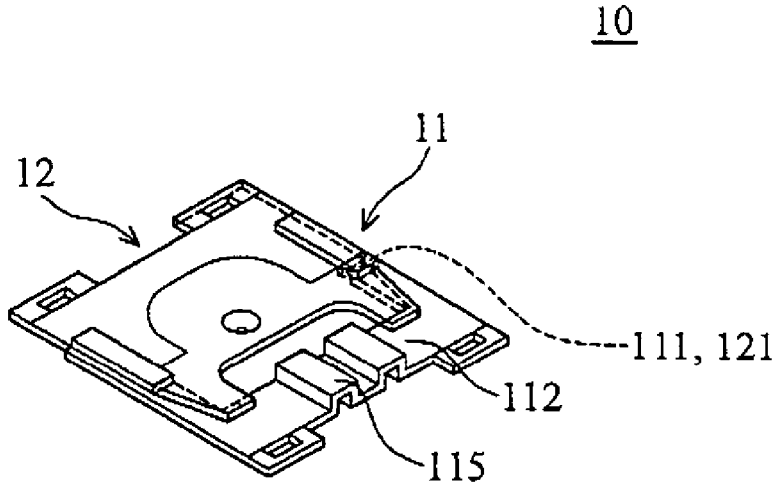
Figure 6:
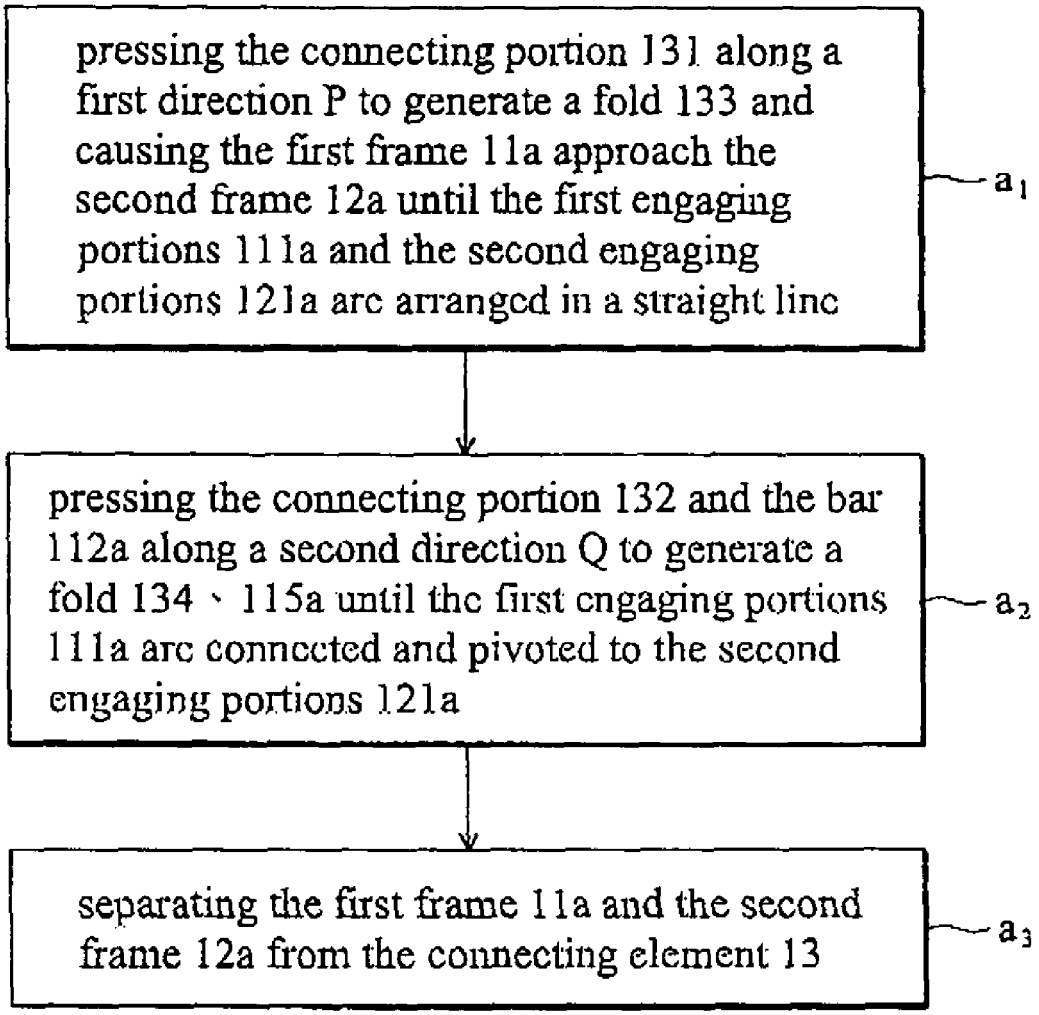
FIG. 6 shows a flow chart of another embodiment of an X-structure of the invention.
Figure 7A:
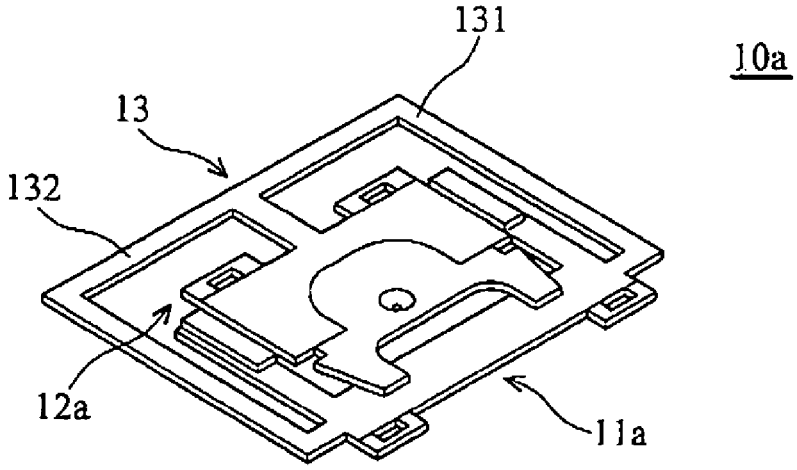
FIGS. 7A-7D are schematic views showing the assembly of another embodiment of an X-structure of the invention.
Figure 7B:
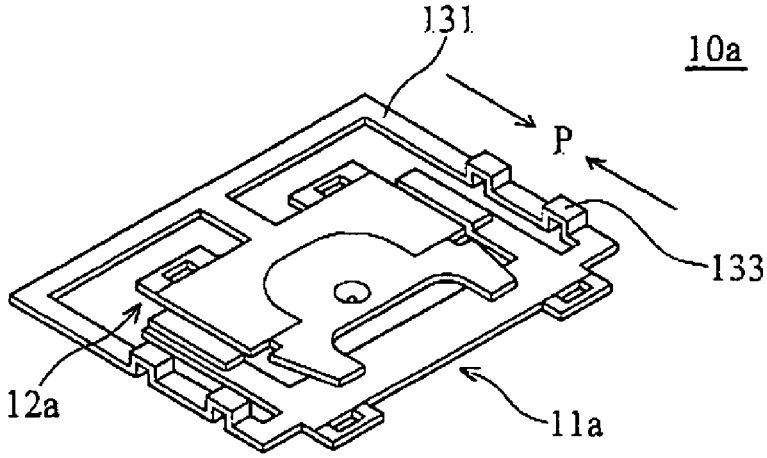
Figure 7C:
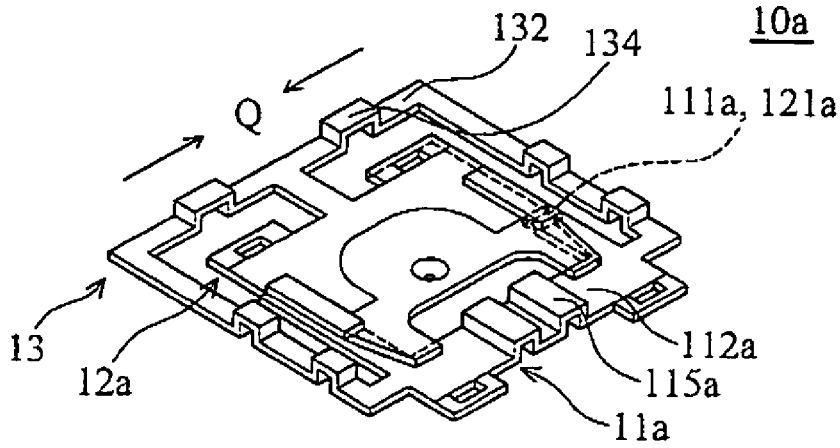
Figure 7D:
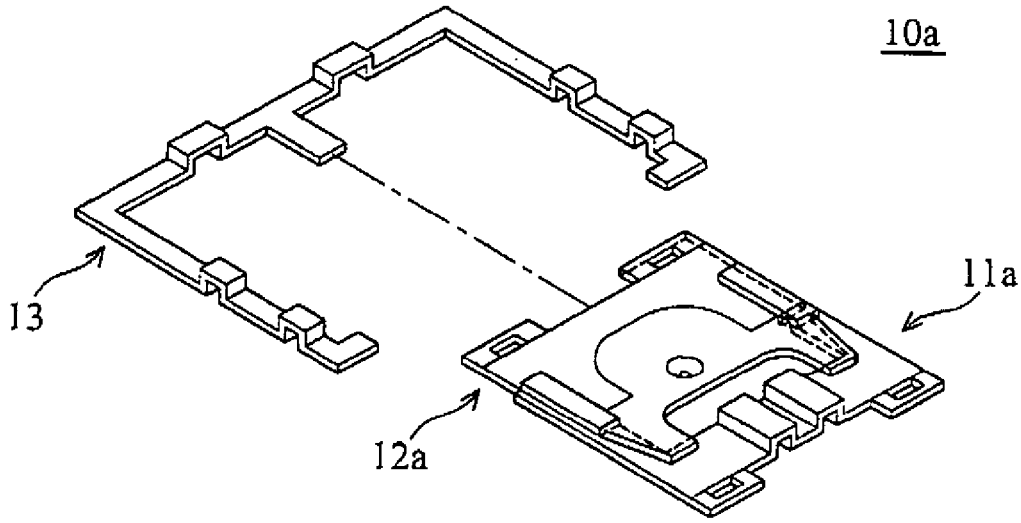

FIGS. 4, 5A and 5B show an embodiment of a method for manufacturing an X-structure. The steps of the method comprise providing the X-structure 10 comprising the first frame 11 and the second frame 12, wherein the first frame 11 comprises the first engaging portions 111 and the bar 112 connecting to the first engaging portions 111 and the second frame 12 comprises the second engaging portions 121; pressing the bar 112 to generate the fold 115 until the first engaging portions 111 are connected and pivoted to the second engaging portions 121. Note that the first frame 11 and the second frame 12 are manufactured by stamping.

Referring to FIGS. 6 and 7A to 7D, an X-structure 10*a* comprises a first frame 11*a*, a second frame 12*a*, a connecting element 13, wherein the connecting element 13 is connected to the first frame 11*a* and the second frame 12*a*. The first frame 11*a* comprises a pair of first engaging portions 111*a* and a bar 112*a*. The second frame 12*a* comprises a second 121*a*. The connecting element 13 comprises a first connecting portion 131 and a second connecting portion 132.

The steps manufacturing an X-structure 10*a* comprise: pressing the connecting element 131 along a first direction P (shown in FIG. 7B) to generate a fold 133 and causing the first frame 11*a* to approach the second frame 12*a* until the first engaging portions 111*a* and the second engaging portions 121*a* are arranged in a straight line; pressing the connecting element 131 and the bar 11*a* along a second direction Q (shown in FIG. 7C) to generate a fold 134 and 115*a* until the first engaging portions 11*a* are connected and pivoted to the second engaging portions 121*a*; separating the first frame 11*a* and the second frame 12*a* from the connecting element 13. In this embodiment, the first direction P is approximately perpendicular to the second direction Q. The first frame 11*a*, the second frame 12*a* and the connecting portion 13 are metal and stamped. Thus, stamping makes mass production of X-structures possible. The connecting elements 13 connect to X-structures. Moreover, before the connecting element 13 is connected to the X-structure 10, the connecting element 13 and the X-structure 10 can be rolled.

The invention provides an X-structure of a key and a manufacture method thereof. The invention not only decreases costs but also increases yield.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for manufacturing an X-structure, wherein the steps comprise:

providing an X-structure comprising a first frame and a second frame, wherein the first frame comprises a pair of first engaging portions and a bar connecting to the first engaging portions, and the first engaging portions extend from the bar, and wherein the second frame comprises a pair of second engaging portions;

pressing the bar to generate a fold portion on the bar until the first engaging portions are engaged with the second engaging portions.

2. The manufacturing method as claimed in claim 1, wherein the first engaging portions and the second engaging portions comprises metal.

3. The manufacturing method as claimed in claim 2, wherein the first frame and the second frame are stamped.

4. An X-structure of a key, comprising:

a first frame, comprising a pair of first engaging portions and a bar, wherein the first engaging portions extend from the bar, and a fold portion is formed on the bar; and a second frame, comprising a pair of second engaging portions, wherein the first engaging portions are engaged with the second engaging portions via the deformation of the connecting portion.

5. The X-structure of a key as claimed in claim 4, wherein the first engaging portions and the second engaging portions comprises metal.

6. A key structure, comprising:

a keycap;

a base;

a first frame, comprising a first end, a second end, a pair of first engaging portions and a bar, wherein the first engaging portions extend from the bar, and a fold portion is formed on the bar; and a second frame, comprising a third end, a fourth end and a pair of engaging portions;

wherein the first engaging portions are engaged with the second engaging portions via the deformation of the connecting portion;

the first end and the third end support the keycap; and the second end and the fourth end are connected to the base.

7. The key structure as claimed in claim 6, wherein the base further comprises a first connector and a second connector respectively connected to the second end and the fourth end.

8. The key structure as claimed in claim 6, wherein the second end and the fourth end comprise two holes, and wherein the first connector and the second connector comprise protrusions engaged with the holes.

9. The key structure as claimed in claim 6, further comprising an elastic element, located between the keycap and the base, and comprising metal.

* * * * *